US005358179A

United States Patent [19]

Lund et al.

[11] Patent Number: 5,358,179

[45] Date of Patent: Oct. 25, 1994

[54] ATOMIZATION SYSTEMS FOR HIGH VISCOSITY PRODUCTS

[75] Inventors: Mark T. Lund, West Chester; Gerard L. Buisson, Cincinnati, both of Ohio

[73] Assignee: The Procter & Gamble Company, Cincinnati, Ohio

[21] Appl. No.: 111,726

[22] Filed: Aug. 18, 1993

[51] Int. Cl.[5] ..... B05B 1/26

[52] U.S. Cl. ..... 239/333; 239/490; 239/544

[58] Field of Search ..... 239/543, 544, 545, 486, 239/490, 333

[56] References Cited

U.S. PATENT DOCUMENTS

| | | | |
|---|---|---|---|
| 1,055,789 | 3/1913 | Papa-Fedoroff et al. . | |
| 1,696,196 | 12/1928 | Gray | 239/544 |
| 2,141,077 | 12/1938 | Baker . | |
| 2,235,258 | 3/1941 | Jones . | |
| 2,302,021 | 11/1942 | Freeman . | |
| 2,499,084 | 2/1950 | Bahnson, Jr. . | |
| 2,499,092 | 2/1950 | Burnam . | |
| 2,536,832 | 1/1951 | Altorfer . | |
| 2,605,144 | 7/1952 | Northup | 239/544 |
| 2,651,547 | 9/1953 | Calhoun . | |
| 2,785,926 | 3/1957 | Lataste . | |
| 2,812,213 | 11/1957 | Bede . | |
| 2,930,532 | 3/1960 | Johnson | 239/335 |
| 3,061,202 | 10/1962 | Tyler | 239/333 |
| 3,075,708 | 1/1963 | Cooprider | 239/490 |
| 3,125,298 | 3/1964 | Iwata | 239/543 |
| 3,406,913 | 10/1968 | Frangos | 239/543 |
| 3,568,933 | 3/1971 | MacGuire-Cooper | 239/543 |
| 3,625,437 | 12/1971 | Garrigou | 239/469 |
| 3,680,793 | 8/1972 | Tate et al. | 239/468 |
| 3,701,478 | 10/1972 | Tada | 239/333 |
| 3,761,022 | 9/1973 | Kondo | 239/333 |
| 3,762,652 | 10/1973 | Huling | 239/469 |
| 4,367,847 | 1/1983 | Bayer | 239/337 |
| 4,664,314 | 5/1987 | O'Brien et al. | 239/469 |
| 4,941,595 | 7/1990 | Montaner et al. | 222/321 |
| 5,025,958 | 6/1991 | Montaner et al. | 222/321 |
| 5,064,105 | 11/1991 | Montaner | 222/321 |
| 5,088,649 | 2/1992 | Hanson et al. | 239/329 |
| 5,156,304 | 10/1992 | Battegazzore | 222/341 |
| 5,249,747 | 10/1993 | Hanson et al. | 239/373 |

FOREIGN PATENT DOCUMENTS

WO93/06749 4/1993 PCT Int'l Appl. .

OTHER PUBLICATIONS

Calmar Inc. Fact Sheet, Mark IV, distributed Fall 1992.

Show in Print, The Mark IV, A New Generation Fine--Mist Sprayer-Article from pp. 80-81 of Sep. 1992 issue of Happi Magazine.

MS150 Precompression Spring Force Variations, Calmar letter dated Oct. 23, 1991.

*Primary Examiner*—Karen B. Merritt

*Attorney, Agent, or Firm*—Dean L. Garner

[57] ABSTRACT

The present invention pertains to improved atomization systems for comparatively higher viscosity liquid products. More particularly, the present invention provides an improved product delivery system which combines a pre-compression type pump mechanism with a nozzle having two or more orifices configured to discharge corresponding jets or streams of the product which impinge upon one another to provide a finely dispersed spray. The pre-compression pump mechanism ensures that the product will only be delivered when sufficient pressure is available for atomization. Regardless of the speed or authority with which the pump mechanism is actuated, pressure within the pump will accumulate without product discharge until a lower pressure threshold is reached, at which time a valve opens to permit product discharge with sufficient pressure for atomization. When the fluid streams impinge upon one another, the fluid is broken up into a finely dispersed mist which may then be directed toward the surface to be coated. In a configuration particularly well-suited for comparatively higher viscosity fluids, the nozzle assembly of the product delivery system imparts additional relative velocity to the jets by introducing a swirl component of velocity prior to impingement, thus enhancing the atomization of the product.

20 Claims, 4 Drawing Sheets

ATOMIZATION SYSTEMS FOR HIGH VISCOSITY PRODUCTS

FIELD OF THE INVENTION

The present invention pertains to improved atomization systems for comparatively higher viscosity liquid products. More particularly, the present invention provides improved manually operated atomization systems which combine impingement-type nozzles with pre-compression type pump mechanisms in order to provide a consistent, high quality, finely-atomized spray.

BACKGROUND OF THE INVENTION

The quantity of liquid product dispensed and the quality of the spray pattern are critical parameters which have a substantial impact on the performance of a liquid product applied via an atomized spray. This is particularly true when the liquid product is being utilized as a thin film coating on a surface, and the total quantity of liquid product applied and quality of the spray pattern directly impact the thickness and evenness of the product coating.

In view of the ever-increasing awareness and concern among consumers with respect to the use of chlorofluorocarbon (CFC) propellants (now largely discontinued due to their impact upon the ozone layer) and volatile organic compound (VOC) propellants (which aggravate low altitude pollution problems, and many are highly flammable), there has been a trend away from pre-pressurized aerosol-type dispensing systems toward systems which utilize a manually-operated pump-type mechanism to force fluid through a specially-designed nozzle assembly to atomize the liquid product.

Comparatively higher viscosity liquid products present an additional challenge in terms of atomization, as the liquid has a tendency to resist break-up rather than being dispensed as a finely dispersed mist. As a general proposition, the less finely dispersed the spray produced, the more difficult is it to achieve a comparatively thin and uniform layer of product, and hence product effectiveness in use is correspondingly diminished.

While there are many products which may be applied in this fashion, one particular product application of current interest is in the area of oil-based fluid products used in food preparation, such as pan coatings and flavor enhancers. A thin, even coating of the oil-based product is desirable in order to provide for non-stick baking characteristics in the pan coating context and to prevent over-application of flavor enhancers. Such products usually comprise a vegetable oil and may optionally include a small quantity of additives for stability, performance, and flavor enhancement.

Some formulations require the addition of thinning agents such as water or alcohol in order to reduce the viscosity of the product to the point where it can be atomized with conventional spray technology. Such thinning agents are less than desirable from a consumer perspective because of their impact upon the performance of the product, the taste of the food product, and (with some thinners such as alcohol) the accompanying scent of the thinner. Other thinners such as water-based thinners may introduce microbial growth problems in the product.

While commercially available dispensing systems employing single-orifice, swirl-type atomizing nozzles may work satisfactorily with lower viscosity formulations, their performance with comparatively higher viscosity formulations suffers due to two major factors. First, viscous losses with comparatively higher viscosity fluids do not allow the fluid to attain enough swirl velocity to form a conical film. Second, the viscous nature of the fluid itself resists break-up of the fluid.

One currently commercially available pump sprayer for cooking oil products employs a nozzle design which produce two impinging jets of the product which collide outside the nozzle to atomize the liquid product. The performance of these spray systems suffers due to use of conventional pump technology which allows the product to emerge in a poorly atomized spray at the beginning and end of each pump stroke when the available pressure is less than required. Comparatively high viscosity fluids typically have a narrower window of operating pressures which will provide satisfactory atomization, with such operating windows becoming increasingly narrow with increasing viscosity. Under some circumstances, such as when the pump is slowly actuated, a higher viscosity product fails to be atomized at all, and emerges from the nozzle assembly in a fluid stream. This results in wasted product and oversaturation of the food item or baking surface to be coated. Heavy drippage of product from the sprayer may also occur, which is generally messy and unsanitary in a food preparation environment.

Accordingly, it would be desirable to provide a manually operated pump-type product delivery system which would provide for a well-atomized, finely-dispersed spray of product under all actuation circumstances even when higher viscosity formulations are utilized.

SUMMARY OF THE INVENTION

The present invention provides an improved product delivery system which combines a pre-compression type pump mechanism with a nozzle having two or more orifices configured to discharge corresponding jets or streams of the product which impinge upon one another to provide a finely dispersed spray.

The pre-compression pump mechanism ensures that the product will only be delivered when sufficient pressure is available for atomization. Regardless of the speed or authority with which the pump mechanism is actuated, pressure within the pump will accumulate without product discharge until a lower pressure threshold is reached, at which time a valve opens to permit product discharge with sufficient pressure for atomization. Correspondingly, when available pressure begins to fall at the end of a pump stroke (or the trigger or actuator button is released during an incomplete cycle), the valve closes when the pressure falls below this threshold, thus eliminating product streaming or dribble at the end of the delivery stroke. When the fluid streams impinge upon one another, the fluid is broken up into a finely-dispersed mist which may then be directed toward the surface to be coated.

In a configuration particularly well-suited for comparatively higher viscosity fluids, the nozzle assembly of the product delivery system imparts additional relative velocity to the jets by introducing a swirl component of velocity prior to impingement, thus enhancing the atomization of the product. This swirl element is achieved by the inclusion of individual swirl chambers in the passageways leading to each outlet orifice. The fluid streams preferably rotate in the same direction (i.e., clockwise or counterclockwise) such that a maximum relative velocity is achieved at their point of initial impingement.

The resulting product delivery system provides a consistent, high quality spray for a higher viscosity product formulation, rendering it easy to use and eliminating the need for oil additives to thin the oil as is required in many other product delivery systems.

BRIEF DESCRIPTION OF THE DRAWINGS

The present invention will be better understood with reference to the following Detailed Description and to the accompanying Drawing Figures, in which.

With respect to all Drawing Figures, unless otherwise noted like elements are identified with like numerals for simplicity and clarity.

DETAILED DESCRIPTION OF THE INVENTION

Figure 1:
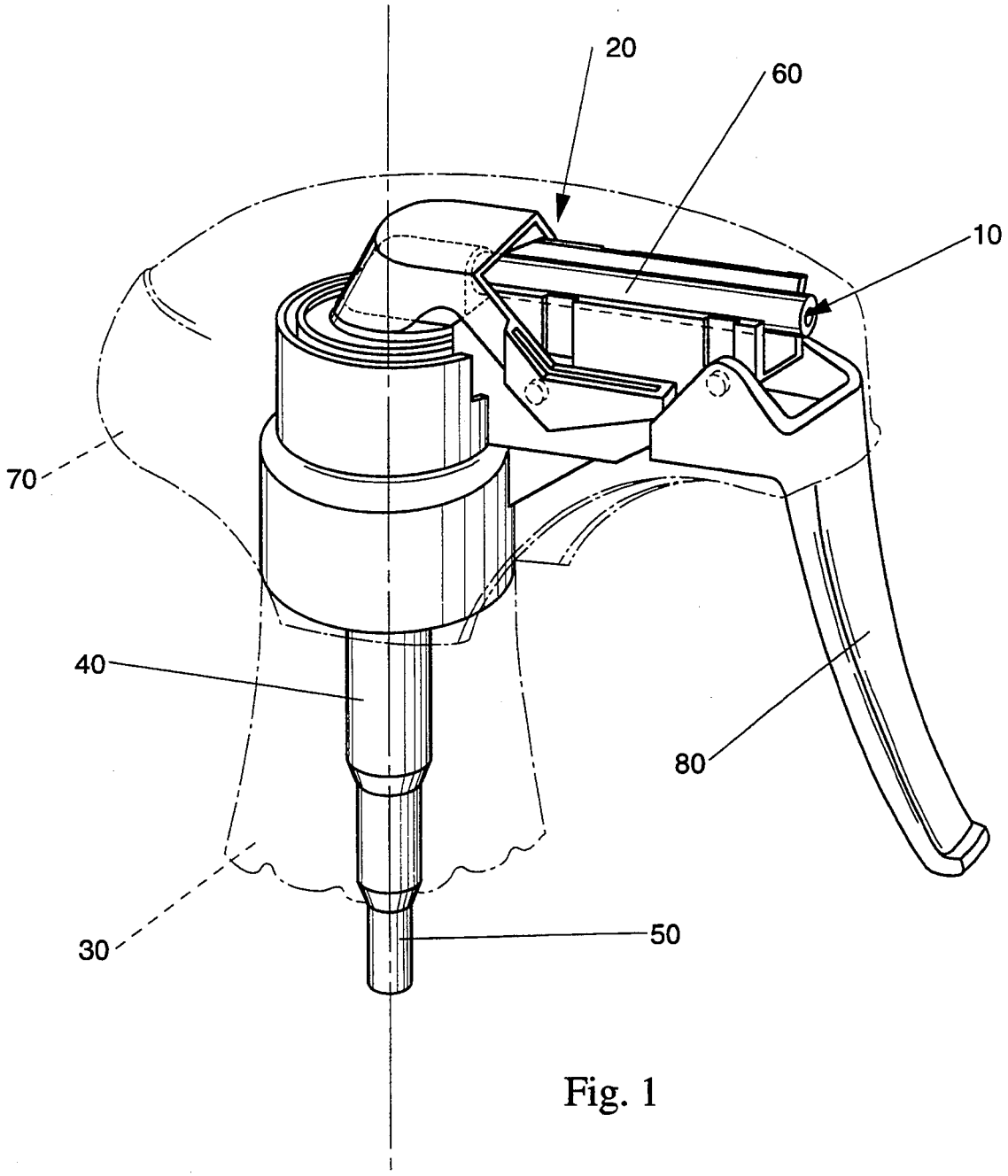
FIG. 1 is a perspective view of a product delivery system according to the present invention, with the container and outer cap shown via outline only.

FIG. 1 shows an improved product delivery system according to the present invention. The system includes a nozzle assembly 10 incorporated into an pump assembly 20, a container 30 (shown in outline only) to contain the fluid product, a pre-compression type pump mechanism 40, and a supply tube 50 extending downward within the container 30 from the pump mechanism 40. The nozzle assembly 10 is inserted into a delivery tube 60, and the pump assembly 20 may be covered by a housing 70 (shown in outline only). In the trigger-type product delivery system depicted, the trigger 80 serves as an actuator.

While a wide variety of pre-compression type pump mechanisms may be suitable for use in the present invention, the particular trigger-type version illustrated in FIG. 1 is illustrative of the operating features typical of such pump mechanisms and is a presently preferred configuration for commercial applications. A more detailed description of the features and components of this pump assembly may be found in U.S. Pat. No. 5,156,304, issued Oct. 20, 1992 to Battegazzore, which patent is hereby incorporated herein by reference. Pump assemblies of this general type are commercially available versions sold by Guala S.p.A. under the trade name "Guala Spray System".

As the operating principles of pre-compression type pump mechanisms themselves are generally well-known, a brief overview of their operation with respect to the product delivery systems according to the present invention is as follows: To begin a pump cycle, the trigger or actuator is actuated by finger pressure, increasing the fluid pressure within the pump assembly. The pressurized fluid acts upon a discharge valve, causing it to open to a delivery passageway once the force on the discharge valve exceeds the biasing force of a pre-compression spring. The pressurized fluid travels through the delivery passageway to the nozzle assembly (which is depicted in greater detail in the succeeding Figures), where it is discharged as a finely atomized product spray. Once the pump mechanism reaches the end of its travel (or the trigger or actuator button is released during an incomplete cycle), and pressure within the pump assembly diminishes to the point where the discharge valve no longer is held open, the discharge valve closes and fluid flow out of the orifices ceases. If the trigger or actuator is then released, a spring returns the trigger or actuator to its initial position (thereby drawing fluid up through the supply tube and into the pump assembly), where it is ready for the next pumping cycle.

Figure 2:
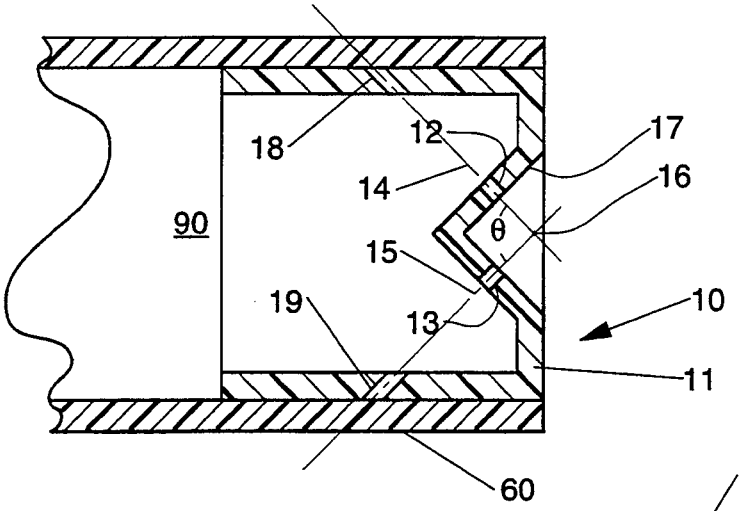
FIG. 2 is an enlarged elevational sectional view of one nozzle assembly suitable for use with the present invention.

FIG. 2 is an enlarged elevational sectional view of the nozzle assembly 10 shown in FIG. 1. The nozzle assembly 10 in the presently preferred configuration shown comprises a hollow thimble-like nozzle insert 11 which is inserted into the delivery tube 60 as shown in FIG. 1. The nozzle assembly 10 includes two outlet orifices 12 and 13 which define corresponsing discharge axes 14 and 15, respectively. The impingement point 16 represents the location of the intersection between the discharge axes 14 and 15. In the nozzle configuration shown in FIG. 2, this impingement occurs within the confines of the nozzle assembly in an enlarged, preferably conical, recess 17.

The interior of the delivery tube 60 forms a delivery passage 90 for conducting the fluid from the pump mechanism 40 to the nozzle assembly 10. The sum of the cross-sectional areas of the outlet orifices 12 and 13 is preferably less than the cross-sectional area of the delivery passageway 90, so as to provide for a higher fluid velocity as the fluid passes through the outlet orifices 12 and 13 and a corresponding increase in the kinetic energy of the fluid streams. While the nozzle assembly 10 may be formed in any suitable fashion, a presently preferred method of forming the nozzle insert 11 is by injection molding, and the holes 18 and 19 through the outer wall of the insert 11 provide access for the mold pins required to form the orifices 12 and 13 during molding. These holes 18 and 19 are sealed by the delivery tube 60 once assembly is completed.

FIG. 2 also depicts the impingement angle $\theta$ (Theta), which represents the included angle between the discharge axes 14 and 15 of the outlet orifices 12 and 13. As defined herein, the impingement angle $\theta$ will of necessity be some value between 0° and 180°, with the 0° representing parallel streams which never intersect and 180° representing two streams intersecting head on. The impingement angle $\theta$ in nozzles for use with the present invention is preferably between about 20° and about 160°, and more preferably between about 45° and about 90°. A presently preferred impingement angle which has performed well is about 60°.

Figure 3:
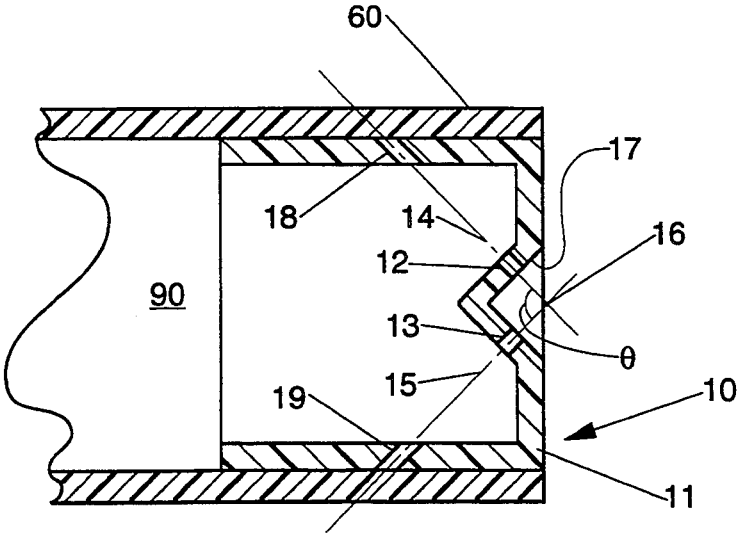
FIG. 3 is an enlarged elevational sectional view of another nozzle assembly suitable for use with the present invention.

FIG. 3 depicts a nozzle assembly substantially as shown in FIG. 2, but with the geometry of the nozzle insert 11 adjusted such that the discharge axes 14 and 15 intersect at an impingement point 16 which is beyond the face of the nozzle assembly.

Whether the discharge axes intersect within or beyond the nozzle assembly, an important consideration in selecting a nozzle geometry is the distance the impinging fluid streams have to travel beyond the orifices before impingement takes place. In general, the farther the streams must travel before impingement, the greater the toll that air resistance takes upon the kinetic energy possessed by the fluid streams. This tends to reduce the energy available to break the fluid into a finely atomized spray. The impingement angle and other features of nozzle geometry such as impingement point location may be tailored to suit a particular application in terms of product characteristics, desired spray pattern, required projection distance of the spray beyond the nozzle, etc.

Figure 4:
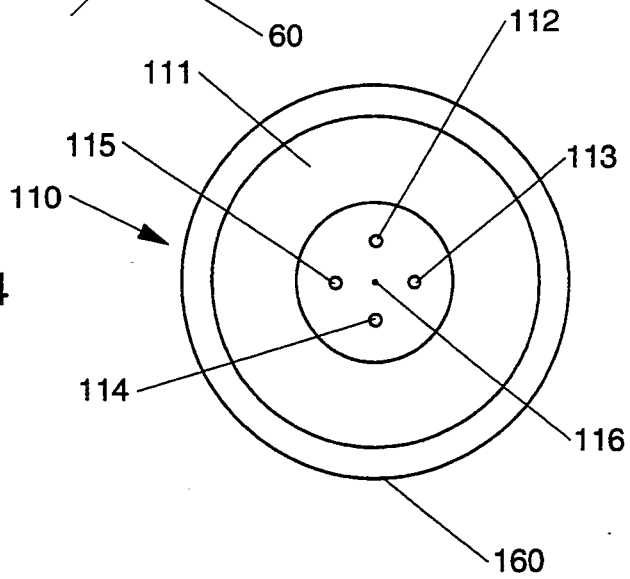
FIG. 4 is an enlarged frontal view of still another nozzle assembly suitable for use with the present invention.

In order to have impinging fluid streams for atomization, a minimum of two outlet orifices are required. While two outlet orifices are depicted in FIGS. 2 and 3, however, depending upon the desired spray pattern and the characteristics of the particular product formulation, it may be desirable to include three, four, or more orifices to produce a like number of impinging fluid streams. FIG. 4 is a representative frontal view of a nozzle assembly 110 (similar to the nozzle assembly 10 of FIG. 3) having a nozzle insert 111 in a delivery tube 160, but employing four discharge orifices 112, 113, 114, and 115 in the conical recess 117, with the impingement point denoted by the numeral 116. In FIG. 4, the outlet orifices are arranged such that they are evenly spaced around the nozzle insert, and thus would produce a symmetrical, generally conical spray pattern. The arrangement of the outlet orifices as well as their number may be tailored to suit a particular application.

One additional consideration when selecting the number of orifices to employ is that in order to keep the quantity of product dispensed per pumping cycle at a desired level, increasing the number of orifices typically means that each orifice therefore becomes smaller in cross-section. Smaller orifices are frequently more prone to clogging in service, which leads to a degradation in spray pattern quality. Representative outlet orifice diameters for use in a two-orifice nozzle which have performed satisfactorily is between about 0.010 inches (0.254 mm) and about 0.018 inches (0.457 mm), and are preferably approximately 0.014 inches (0.356 mm).

Figure 5:
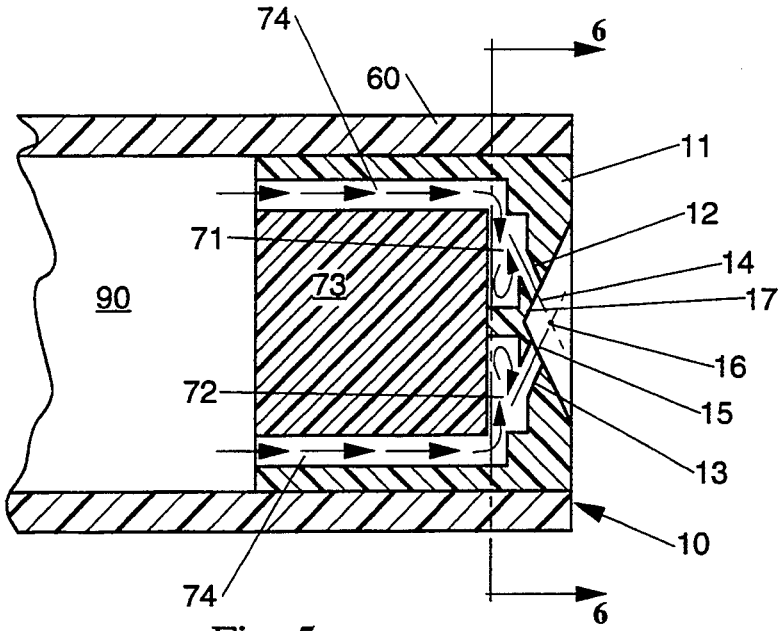
FIG. 5 is an enlarged elevational sectional view of a further nozzle assembly suitable for use with the present invention.
Figure 6:
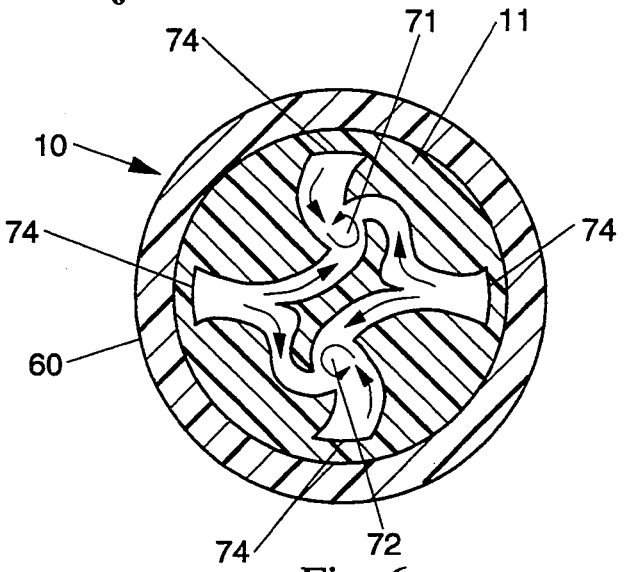
FIG. 6 is a cross-sectional view of the nozzle assembly of FIG. 5 taken along line 6—6.
Figure 7:
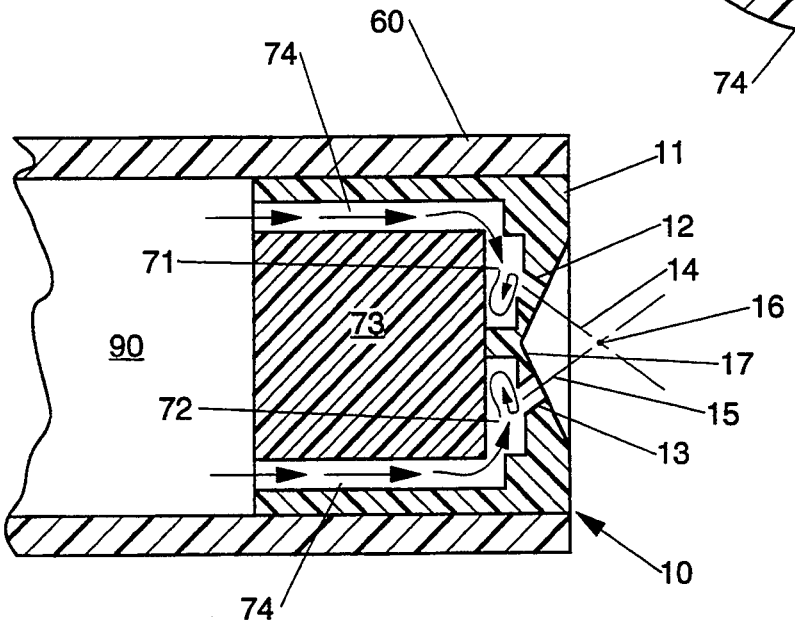
FIG. 7 is an enlarged elevational sectional view of still a further nozzle assembly suitable for use with the present invention.

FIGS. 5, 6, and 7 depict an additional feature which may be incorporated into nozzle assemblies for use in product delivery systems according to the present invention, particularly for use with fluids having comparatively higher viscosities.

FIG. 5 is a view similar to FIG. 2 of a nozzle assembly 10 which produces product streams which impinge within the confines of the nozzle assembly. The nozzle assembly of FIG. 5 includes all of the elements of the nozzle assembly depicted in FIG. 2, and in addition includes individual swirl chambers 71 and 72 located in each delivery passageway to induce a swirling motion into the fluid streams prior to reaching the discharge orifices 12 and 13. The streams are thus rotating about their respective discharge axes 14 and 15 prior to impingement, preferably both rotating in the same direction as shown in FIG. 5 (i.e., clockwise or counterclockwise) such that a maximum relative velocity is achieved at their point of initial impingement. This swirling motion imparts additional rotational relative velocity to the jets, thus enhancing the atomization of comparatively high viscosity formulations.

FIG. 6, which is a cross-sectional view of the nozzle assembly of FIG. 5 taken along line 6—6, more clearly illustrates the configuration of the passages 74 which channel the fluid from the delivery passage 90 around the post 73 and into the swirl chambers 71 and 72. Any number of these passages 74 may be employed, whether formed as part of the nozzle insert 11 as herein depicted or formed as part of the post 73, but in the configuration depicted in FIGS. 5–7 the number of these passages is four. These passages are arranged to tangentially feed fluid into the perimeter of each swirl chamber so as to produce the rotational motion depicted by the swirling arrows. As the fluid leaves the swirl chambers and enters the outlet orifices 12 and 13, the fluid streams are swirling about the discharge axes 14 and 15. When these swirling streams impinge upon one another, not only do they collide and break up the fluid as with conventional impingement nozzles, but this swirling motion (particularly if the streams are rotating in the same angular direction, as is preferred) causes the impinging fluids to break apart even more thoroughly due to the increased kinetic energy (based upon both linear velocity and angular relative velocity) possessed by the streams.

FIG. 7 is a view similar to FIG. 3 of a nozzle assembly 10 which produces product streams which impinge beyond the confines of the nozzle assembly. The nozzle assembly of FIG. 7 includes all of the elements of the nozzle assembly depicted in FIG. 3, and in addition includes individual swirl chambers 71 and 72 as described above with respect to FIG. 5.

Regardless of the precise nozzle design employed, the key to achieving the improved atomization properties of delivery systems according to the present invention is the inclusion of a pre-compression type pump mechanism.

In order to achieve satisfactory atomization with impingement-type nozzle designs, comparatively higher viscosity fluids require higher operating pressures to drive the fluid at velocities high enough to achieve atomization via impingement. Such fluids also have a more narrow operating window of pressures which will perform satisfactorily, particularly in terms of a comparatively higher low-pressure threshold below which the resulting spray pattern will be unsatisfactory. When the available operating pressure is less than this threshold, the resulting fluid dispensed will tend to emerge in a stream rather than a mist or spray. Heavy drippage of product from the sprayer may also occur, which is generally messy and undesirable from a consumer perspective.

The difficulty encountered with conventional direct-action type pump mechanisms is that pressure tends to build gradually during the early stages of a pump stroke, reaching a maximum somewhere during the travel of the pump toward its end-of-travel limit, then rapidly falling once this limit is reached. The peak pressure is often less (and the pressure rise more gradual) if the pump mechanism is actuated rather slowly, and if the actuation occurs slower than the fluid passes through the orifices pressure may never build up significantly within the dispensing system.

With impingement-type nozzle designs, if the fluid streams have insufficient velocity, the fluid will not be atomized at all but will stream from the outlet orifices, resulting in wasted product and overapplication to the desired surface, as well as a messy and unsanitary cooking environment.

The use of a pre-compression pump mechanism in product delivery systems according to the present invention ensures that the product will only be delivered when sufficient pressure is available for atomization. This is accomplished through the use of a discharge valve which typically utilizes a pre-compression spring of a particular tension to effectively block fluid flow out of the pump chamber during the period of initial pressure rise and during the rapid decrease of pressure at the end of the pumping cycle.

Regardless of the speed or authority with which the pump mechanism is actuated, pressure within the pump will accumulate without product discharge until a lower pressure threshold is reached, at which time a valve opens to permit product discharge with sufficient pressure for atomization. Correspondingly, when available pressure begins to fall at the end of a pump stroke, the valve closes when the pressure falls below this threshold, thus eliminating product streaming or dribble at the end of the delivery stroke. Product is thus discharged only when the operating pressure is within a window which will provide satisfactory atomization based upon the product formulation and nozzle geometry employed. When the fluid streams impinge upon one another, the fluid has sufficient velocity to be broken up into a finely dispersed mist which may then be directed toward the surface to be coated.

Operating pressures (more particularly, the lower pressure thresholds) of the pre-compression type pump mechanisms for use with the present invention are preferably on the order of about 40 to about 100 psig (about 276 to about 689 kPa), and perhaps higher, although this pressure may be tailored to suit any particular application depending upon the product formulation (viscosity in particular) and nozzle geometry employed.

While the improved product delivery systems according to the present invention may be utilized with virtually any fluid product, it has been found to be particularly advantageous in the cooking environment, where it may be utilized to apply pan coatings and flavor enhancers. These products are often formulated with a large percentage (80–100%) of a vegetable oil, and have viscosities typically of between about 60 and about 75 cps. Such products may also include a minor percentage of lecithin, emulsifiers, and may also include flavor enhancers and other ingredients to enhance product performance. Product formulations which have performed well with the product delivery systems of the present invention typically include approximately 88% vegetable oil, approximately 10% lecithin, and approximately 2% of an emulsifier, and have viscosities of approximately 70 cps. Such formulations do not include any thinning agents such as water or alcohol.

Other product formulations besides cooking products, particulary those of comparatively higher viscosities could be employed in product delivery systems according to the present invention. Such products include, but are not limited to: lubricating oils, liquid soaps, laundry detergents, dishwashing detergents, pretreaters, hard surface cleaners, paints, polishes, window cleaners, rust preventatives, surface coatings of all varieties, etc.

Figure 8:
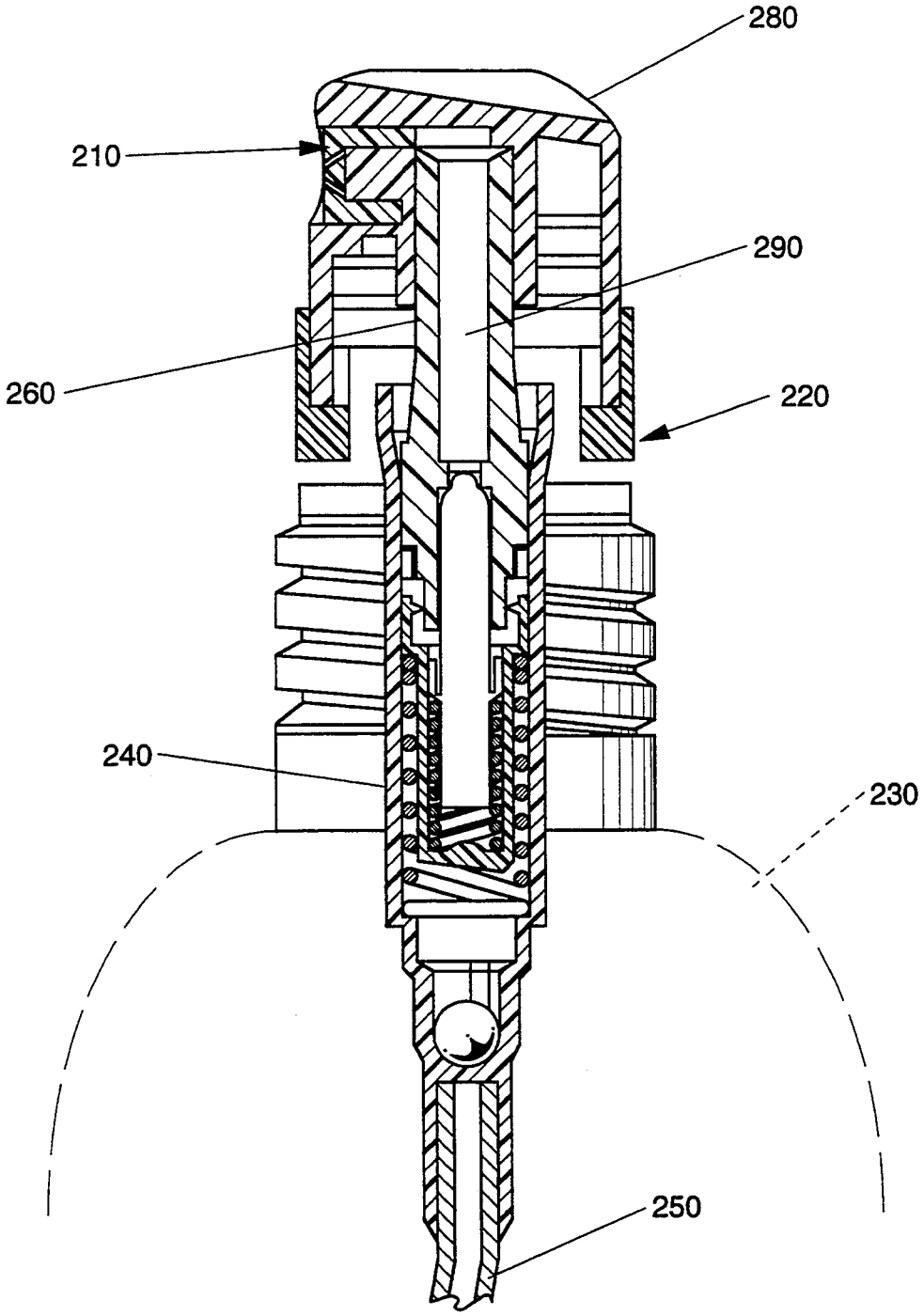
FIG. 8 is an elevational sectional view of an alternative product delivery system configuration according to the present invention.

While a presently preferred version of the improved product delivery systems according to the present invention employs a trigger-type actuation system, as depicted in FIG. 1, a reciprocating finger-pump type of delivery system could also be employed as depicted in FIG. 8. In such a configuration, the finger button 280 replaces the trigger 80 shown in FIG. 1 as the actuation mechanism. Other elements depicted include a nozzle assembly 210 incorporated into an pump assembly 220, a container 230 (shown in outline only) to contain the fluid product, a pre-compression type pump mechanism 240, and a supply tube 250 extending downward within the container 230 from the pump mechanism 240. The nozzle assembly 210 is inserted into the finger button 280 so as to be in communication with delivery passage 290 of delivery tube 260.

Suitable finger-pump type pump assemblies of the type disclosed in FIG. 8 are described in greater detail in U.S. Pat. No. 4,941,595, issued Jul. 17, 1990 to Montaner et al., U.S. Pat. No. 5,025,958, issued Jun. 25, 1991 to Montaner et al., and U.S. Pat. No. 5,064,105, issued Nov. 12, 1991 to Montaner, each of which are hereby incorporated herein by reference. Pump assemblies of these general types are commercially available versions sold by Calmar Dispensing Systems, Inc. under the trade name "Calmar Mark IV".

While particular embodiments of the present invention have been illustrated and described, it would be obvious to those skilled in the art that various changes and modifications can be made without departing from the spirit and scope of the present invention. For example, the product formulation and viscosity can be tailored to suit a particular application, the actuator design and pre-compression pump mechanism can be selected to achieve particular operating characteristics, the container size and design may likewise be varied, the number of impinging fluid streams may be varied, etc. It is intended to cover in the appended claims all such modifications that are within the scope of this invention.

What is claimed is:

1. A dispensing and atomization system for a comparatively high viscosity fluid product, said system comprising:

(a) a comparatively high viscosity fluid product;

(b) a container for storing said product prior to dispensing and atomizing said product;

(c) a manually operated pump sprayer for dispensing said product from said container, said pump sprayer being associated with an opening in said container so as to permit dispensing of said product from within said container when said pump sprayer is actuated during a dispensing operation;

(d) an impingement-type nozzle assembly associated with said pump sprayer for dispensing and atomizing said product, said nozzle assembly including at least two outlet orifices, each of said at least two outlet orifices defining a discharge axis, each of said at least two outlet orifices producing a solid stream of said product along said discharge axis upon actuation of said pump sprayer, said at least two orifices being arranged within said nozzle assembly such that the discharge axes of said at least two outlet orifices intersect to effectuate atomization of said product by causing said solid streams of said product to impinge upon one another; and (e) said pump sprayer further including a pre-compression pump mechanism, wherein said product is dispensed only when a pre-determined pressure value is exceeded within said pump sprayer, said pre-determined pressure value ensuring that said product is discharged from said pump sprayer through said nozzle assembly with sufficient velocity to atomize said product via the impingement of said solid streams.

2. The dispensing and atomization system of claim 1, wherein the discharge axes of said at least two outlet orifices intersect at a point within said nozzle assembly to effect atomization of said product.

3. The dispensing and atomization system of claim 1, wherein the discharge axes of said at least two outlet orifices intersect at a point exterior to said nozzle assembly to effect atomization of said product.

4. The dispensing and atomization system of claim 1, wherein said nozzle assembly includes at least three outlet orifices.

5. The dispensing and atomization system of claim 1, wherein said product has a viscosity of at least about 60 cps.

6. The dispensing and atomization system of claim 1, wherein said product includes at least about 80% by weight of a vegetable oil.

7. The dispensing and atomization system of claim 1, wherein said pump sprayer includes a trigger-type actuator.

8. The dispensing and atomization system of claim 1, wherein said discharge axes define an impingement angle of between about 20° and about 160°.

9. The dispensing and atomization system of claim 8, wherein said discharge axes define an impingement angle of about 60°.

10. The dispensing and atomization system of claim 1, wherein said nozzle assembly further includes at least two delivery passages in fluid communication with said at least two outlet orifices, said at least two delivery passages including means for imparting a swirling action to said solid streams of product before said solid streams reach said at least two outlet orifices.

11. A dispensing and atomization system for a comparatively high viscosity fluid product, said system comprising:

(a) a comparatively high viscosity fluid product;

(b) a container for storing said product prior to dispensing and atomizing said product;

(c) a manually operated pump sprayer for dispensing said product from said container, said pump sprayer being associated with an opening in said container so as to permit dispensing of said product from within said container when said pump sprayer is actuated during a dispensing operation;

(d) an impingement-type nozzle assembly associated with said pump sprayer for dispensing and atomizing said product, said nozzle assembly including at least two outlet orifices and at least two corresponding delivery passages in fluid communication with said at least two outlet orifices, each of said at least two outlet orifices defining a discharge axis, each of said at least two outlet orifices producing a solid stream of said product along said discharge axis upon actuation of said pump sprayer, said at least two orifices being arranged within said nozzle assembly such that the discharge axes of said at least two outlet orifices intersect to effectuate atomization of said product by causing said solid streams of said product to impinge upon one another, said at least two delivery passages including means for imparting a swirling action to said solid streams of product before said solid streams reach said at least two outlet orifices such that said swirling action imparts additional relative velocity to said solid streams of said product prior to their intersection to provide improved atomization of said product; and (e) said pump sprayer further including a pre-compression pump mechanism, wherein said product is dispensed only when a pre-determined pressure value is exceeded within said pump sprayer, said pre-determined pressure value ensuring that said product is discharged from said pump sprayer through said nozzle assembly with sufficient velocity to atomize said product via the impingement of said solid streams.

12. The dispensing and atomization system of claim 11, wherein the discharge axes of said at least two outlet orifices intersect at a point within said nozzle assembly to effect atomization of said product.

13. The dispensing and atomization system of claim 11, wherein the discharge axes of said at least two outlet orifices intersect at a point exterior to said nozzle assembly to effect atomization of said product.

14. The dispensing and atomization system of claim 11, wherein said nozzle assembly includes at least three outlet orifices.

15. The dispensing and atomization system of claim 11, wherein said product has a viscosity of at least about 60 cps.

16. The dispensing and atomization system of claim 11, wherein said product includes at least about 80% by weight of a vegetable oil.

17. The dispensing and atomization system of claim 11, wherein said pump sprayer includes a trigger-type actuator.

18. The dispensing and atomization system of claim 11, wherein said discharge axes define an impingement angle of between about 20° and about 160°.

19. The dispensing and atomization system of claim 18, wherein said discharge axes define an impingement angle of about 60°.

20. The dispensing and atomization system of claim 11, wherein said swirling action imparted to said solid streams causes said solid streams to rotate about the discharge axes of their respective outlet orifices in the same angular direction.

* * * * *